US005544504A

United States Patent [19]

Neher et al.

[11] Patent Number: 5,544,504

[45] Date of Patent: Aug. 13, 1996

[54] DEVICE FOR BLOWING FLUFF OR THE LIKE AWAY FROM A CIRCULAR KNITTING MACHINE AND A CIRCULAR KNITTING MACHINE FITTED WITH SUCH A DEVICE

[75] Inventors: Paul Neher, Messstetten; Wilfried Schick, Bitz, both of Germany

[73] Assignee: SIPRA Patententwicklungs-und Beteiligungsgesellschaft mbH, Albstadt, Germany

[21] Appl. No.: 352,553

[22] Filed: Dec. 8, 1994

[30] Foreign Application Priority Data

Dec. 15, 1993 [DE] Germany ..... 9319234 U
Nov. 10, 1994 [DE] Germany ..... 44 40 075.6

[51] Int. Cl.[6] ..... D04B 35/32
[52] U.S. Cl. ..... 66/168; 15/301
[58] Field of Search ..... 66/168; 15/301

[56] References Cited

U.S. PATENT DOCUMENTS

| | | | |
|---|---|---|---|
| 2,357,714 | 9/1944 | Vossen et al. | 66/168 |
| 2,422,514 | 6/1947 | Allen | 66/168 |
| 2,846,860 | 8/1958 | Shortland | 66/168 |
| 3,269,151 | 8/1966 | Abrams et al. | 66/168 |
| 3,422,640 | 1/1969 | Abrams | 66/168 |
| 3,678,713 | 7/1972 | Woodford | 66/168 X |
| 5,000,013 | 3/1991 | Rovinsky | 66/168 |
| 5,408,850 | 4/1995 | Kawase et al. | 66/168 |

FOREIGN PATENT DOCUMENTS

| | | | |
|---|---|---|---|
| 0619392 | 10/1994 | European Pat. Off. . | |
| 1113786 | 9/1961 | Germany . | |
| 34664 | 1/1965 | Germany . | |
| 7638042 | 5/1978 | Germany . | |
| 2815052 | 10/1979 | Germany . | |
| 7926865 | 12/1980 | Germany . | |
| 3219467 | 7/1983 | Germany . | |
| 3628851 | 3/1987 | Germany . | |
| 3636327 | 4/1987 | Germany . | |
| 3734252 | 4/1988 | Germany . | |
| 229589 | 1/1994 | Taiwan . | |
| 271703 | 9/1970 | U.S.S.R. | 66/168 |
| 2279144 | 12/1994 | United Kingdom . | |

*Primary Examiner*—John J. Calvert
*Attorney, Agent, or Firm*—Michael J. Striker

[57] ABSTRACT

A device for a circular knitting machine for blowing away fluff or the like is provided, having a plurality of blower openings each arranged to move to and fro on a circular path section, and a source of compressed air connected to the blower openings. The device further comprises a holder (23) mounted to rotate to and fro, with a plurality of tubes (28) extending substantially radially and leading to the blower openings, and a distribution device (34) connectible to the source of compressed air. By means of the distribution device (34) the tubes (28) can be connected to the source of compressed air in a predetermined sequence individually or in groups. Also a circular knitting machine have such a device is provided (FIG. 1).

19 Claims, 5 Drawing Sheets

DEVICE FOR BLOWING FLUFF OR THE LIKE AWAY FROM A CIRCULAR KNITTING MACHINE AND A CIRCULAR KNITTING MACHINE FITTED WITH SUCH A DEVICE

This invention relates to a device for a circular knitting machine for blowing away fluff or the like, comprising a plurality of blower openings each arranged to move to and fro on a circular path section and a source of compressed air connected to the blower openings, and to a knitting machine having such a device.

Circular knitting machines with devices for blowing fluff or the like away are known in numerous forms.

A first group of these devices comprises a plurality of substantially radially arranged tubes, mounted on a central rod and provided at their ends with blowing openings; the tubes are either driven by a rotating needle cylinder, dial or take-down device (DE-AS 1 113 786, DE 3 628 851 A1), possible with interposition of a gearbox (DE 3 636 327 A1, DE 3 734 252 A1, DD-PS 34 664) or have a separate drive motor (DE 79 26 865 U1). Devices of this kind require comparatively expensive air distribution arrangements and high capacity compressed air sources.

A second group of devices of a kind not of interest here actually serves to cool the cam systems of a circular knitting machine but is basically and at least partially suitable also for blowing off fluff or the like (DE 76 38 042 U1). In this device the cam system carriers of the needle cylinder and the dial are provided with annular tubes having tubular blower openings and coaxially surrounding the machine axis. Unfavourable pressure conditions arise in these machines if a clear view of the various operating regions is not to be impeded, even when the annular tube is divided into a plurality of sections and the air is fed intermittently to the different sections (DE 3 219 467 A1).

Finally devices of a third kind and of the type initially defined are known, which have closed, circularly curved annular lines provided with blower openings, which are rotatably mounted with the aid of rollers arranged at their periphery and in contrast to the devices of the kind first referred to, move to and fro, i.e. are driven with oscillating movement (DE 2 815 052 A1, U.S. Pat. No. 3,422,640). The compressed air is fed in each case to the annular line through a flexible hose, the annular line itself consisting of a rigid material. Unfavourable pressure conditions arise in these devices also, which can only be improved by an expensive overall construction.

It is an object of this invention to so design the device and the knitting machine mentioned above such that a high cleaning or keeping clean effect is obtained.

According to a further object of the invention the device and the knitting machine mentioned above should have little constructional expense.

Yet another object underlying this invention is to design the device and the knitting machine mentioned above in such a manner that a high cleaning or keeping clean effect can be obtained without the operation of the knitting machine or a clear view of the various operating locations being significantly restricted.

According to this invention, the device comprises a holder mounted to rotate to and fro, said holder having a plurality of tubes extending substantially radially and leading to the blower openings, and a distribution device connectible to the source of compressed air, by means of which distribution device the tubes can be connected to the source of compressed air in a predetermined sequence individually or in groups.

The invention will now be explained in detail in conjunction with the accompanying drawings of an embodiment, in which.

Figure 1:
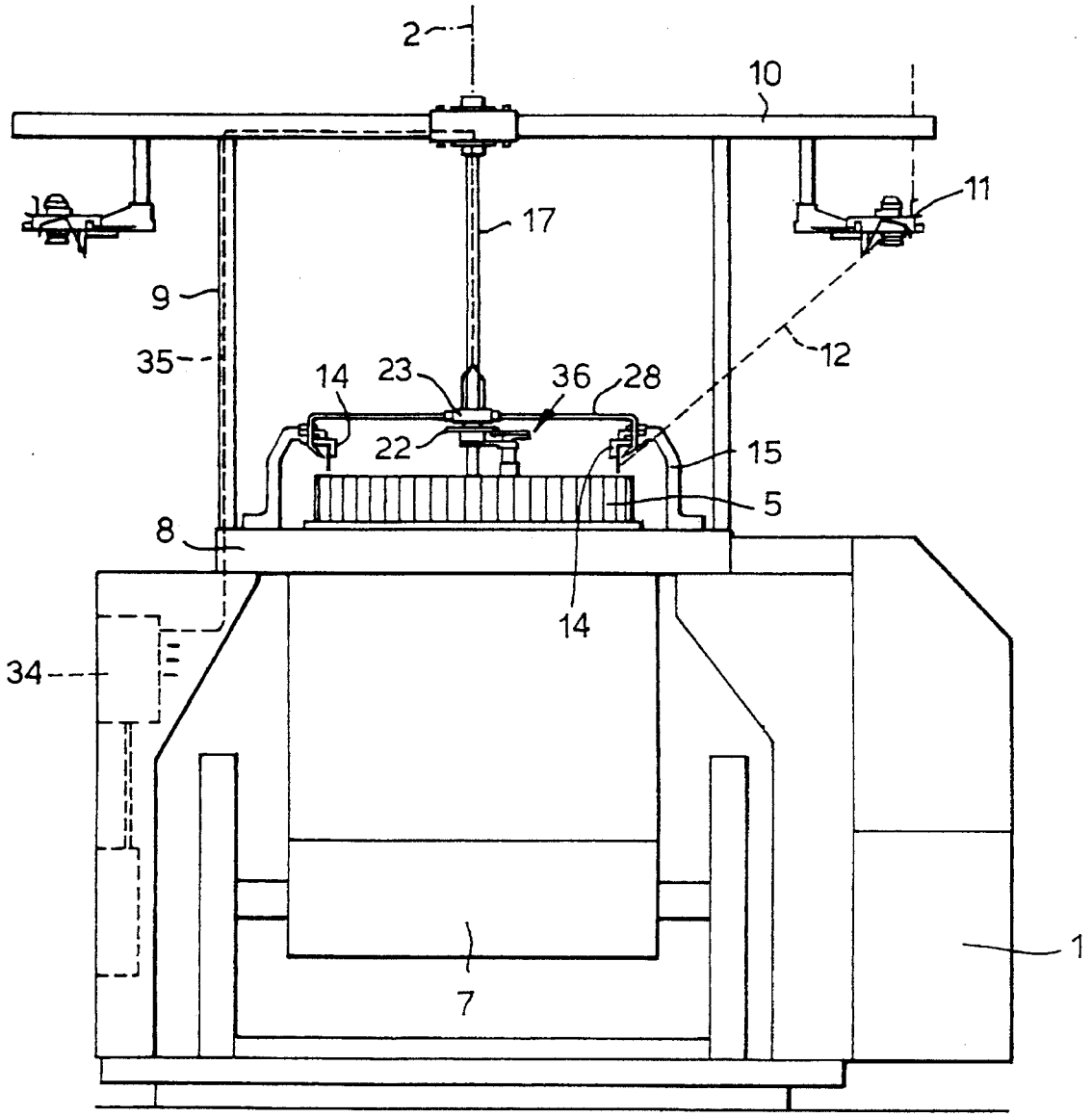
FIG. 1 is a schematic front view of a circular knitting machine with a device according to the invention.
Figure 2:
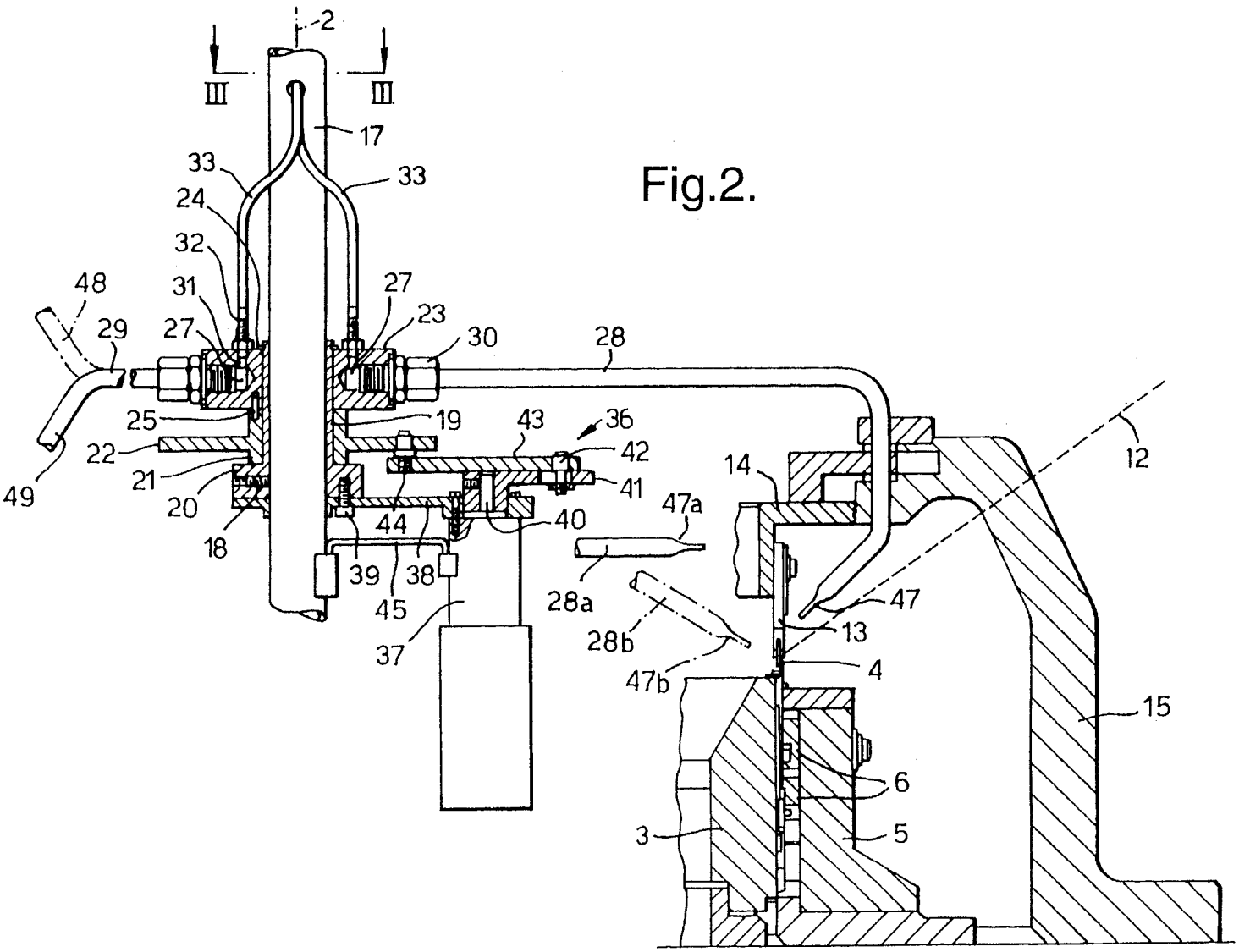
FIG. 2 is partial vertical section through the circular knitting machine according to FIG. 1.

A circular knitting machine is shown schematically in FIGS. 1 and 2 and includes a needle cylinder 3 with a vertical axis 2 rotatably mounted in a frame 1, knitting needles 4 being mounted to move up and down in the needle cylinder. The needle cylinder 3 is surrounded by a cam box ring 5 which has cams 6 for controlling the up and down movement of the knitting needles 4. A take-down and winding up device 7 is arranged below the needle cylinder 3 for the finished knitwear.

A plurality of vertical supports 9 are supported on a baseplate 8 (FIG. 1) of the circular knitting machine and carry a support ring 10, on which there are arranged yarn feed devices 11 for feeding yarns 12 shown in broken lines. The yarn guides 13, which project vertically downwards from a yarn guide ring 14 (FIG. 2), which is supported on brackets 15 mounted on the baseplate 8 and is arranged below the support ring 10. Four such brackets 15 are provided in the embodiment and are distributed round the needle cylinder 3 at angular intervals of about 90°.

Circular knitting machines of the kind described are generally known to the man skilled in the art (e.g. from DE 79 26 865 U1, DE 3 628 851 A1) and therefore do not need to be explained in more detail here.

A rod 17 coaxial with the axis 2 is suspended from radial arms connected to the support ring 10 but not shown in detail and projects into the needle cylinder 3, is arranged stationary and is preferably formed as a hollow shaft. A hollow cylindrical housing 19 is fixed on this rod 17 by means of a screw 18, as FIG. 2 in particular shows, and has a lower, flange-like projection 20. A hub 21 is rotatably and coaxially supported on this projection 20 and a coaxial, e.g. circular disc 22 is formed thereon. The hub 22 supports a holder 23 which also fits coaxially and rotatably on the housing 19 and is secured axially thereon by a circlip 24. The holder 23 is moreover connected rotationally fast with the hub 21 by means of a pin 25, so that it can only rotate in common therewith.

The holder 23 has a plurality of threaded bores 27, four in the embodiment, which are distributed at angular intervals of about 90° on its outer periphery. A tube 28 or 29 provided at its corresponding end with an external thread is screwed into each threaded bore 27 and secured by means of a lock nut 30. A further, e.g. vertically formed threaded bore 31 moreover opens into each threaded bore 27 and a threaded bush 32 is screwed therein in corresponding manner, serving as a connection for a connecting line, preferably a flexible hose 33. Alternatively the tubes 28, 29 and the threaded bush 32 could have flange-like projections on their ends and be fixed on to corresponding threaded sections of the holder 23 by means of screw caps. The hoses 33 are preferably led through the hollow rod 17 to its upper end and from thence through one of the support arms of the support ring 10 and one support 9, to respective connections of a distribution device 34, as in indicated schematically in FIG. 1 by a broken line. It is thus possible to feed each tube 28, 29 individually with compressed air through the associated hose 33 and associated threaded bores 31, 27.

Figure 3:
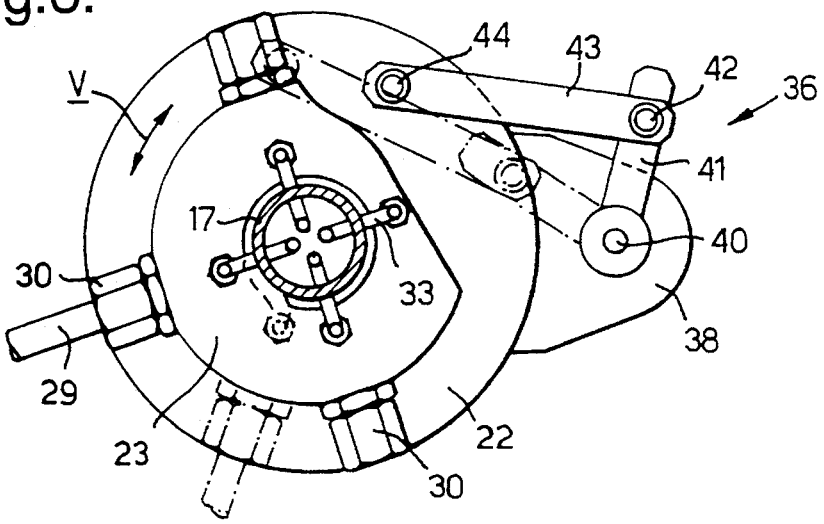
FIG. 3 is a section along the line III—III of FIG. 2.

The holder 23 carrying the tubes 28, 29 can according to FIGS. 2 and 3 rotate together with the disc 22 in oscillating, i.e. to and fro manner. To this end the disc 22 is connected to a crank drive 36. This comprises a rotary drive 37 which is fixed in a support plate 38, which is connected fast to the projection 20 by a screw 39. A crank 41 is fixed on a drive shaft 40 of the rotary drive 37, parallel to and spaced from the axis 2, the crank having its free end connected at a pivot point 42 to one end of a connecting rod 43. The other end of the connecting rod 43 is pivoted to a further pivot point 44 on the edge section of the disc 22. Accordingly, when the drive shaft 40 is put in rotation by the rotary drive 37, on the one hand the pivot point 42 of the crank 41 executes a circulating movement round a circular track and on the other hand the disc 22 and the holder 23 therewith carry out a to and fro oscillating movement in the direction of a double arrow v (FIG. 3) about the axis 2, dependent on the dimensions of the crank drive 36. Two possible positions of the crank drive 36 and the holder 23 are shown in FIG. 3 in broken and full lines respectively.

The dimensions of the crank drive 36 are so selected in the embodiment that the holder 23 is rotated to and fro by so much less than 90° that a tube 28, 29 fixed thereon cannot itself strike against one of the brackets 15 when it, as is shown in FIG. 2, projects radially outside the yarn guide ring 14 from above into the space between two brackets 15.

The rotary drive 37 is preferably an electric motor, which is supplied with current through an electric cable 45 (FIG. 2), which is preferably laid through the hollow rod 17 like the hoses 33.

Figure 4:
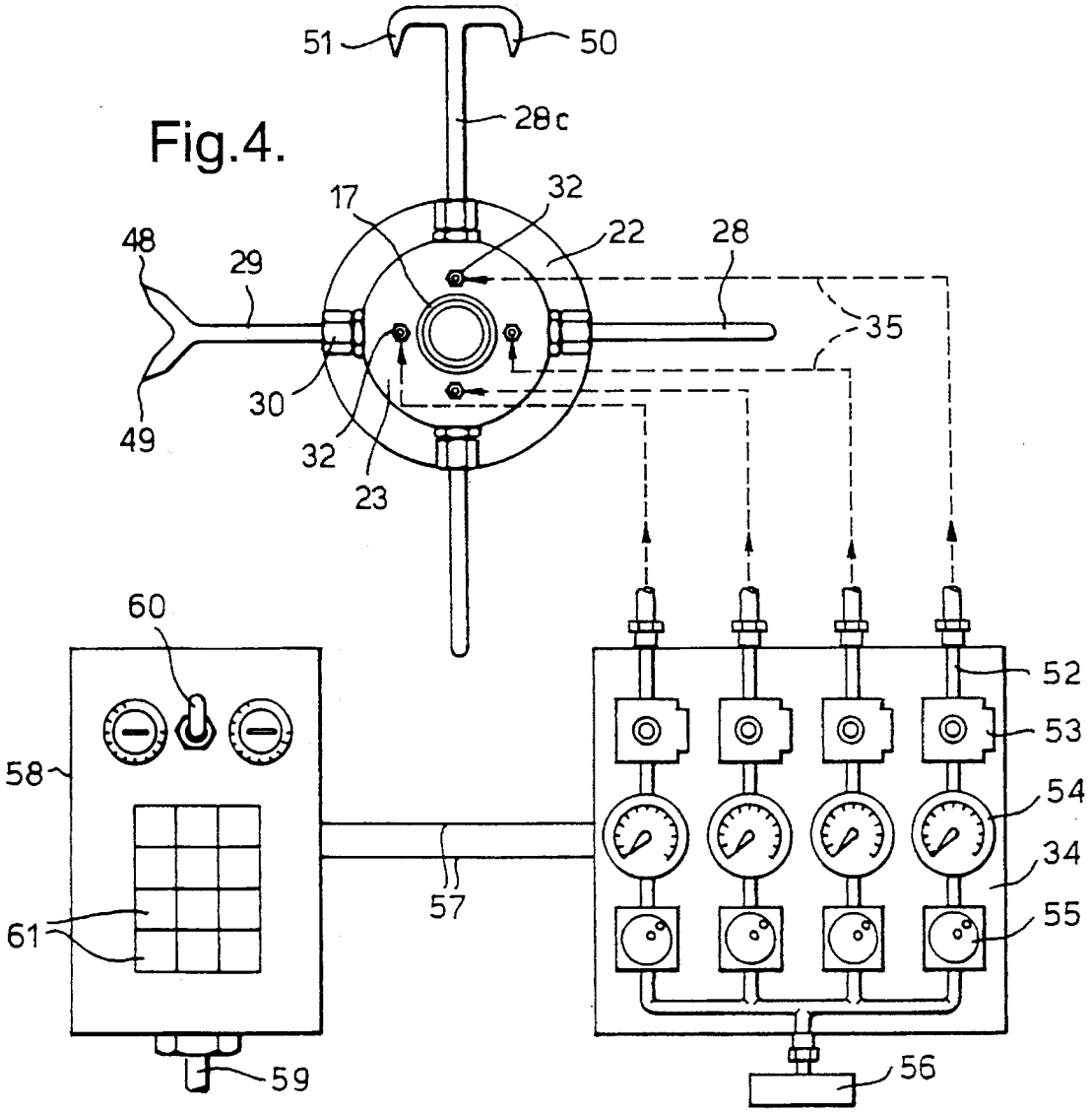
FIG. 4 is a highly schematic plan view like FIG. 3 of the device according to FIGS. 1 to 3 in conjunction with a control device.

According to FIGS. 2 and 4 the tubes 28, 29 are preferably provided at their radially outer ends with nozzle-form blower openings 47, 48 and 49. The tube 28 initially extending substantially horizontally and radially from the holder 23 at a small distance above the yarn guide ring 14 is so bent down at its outer end through e.g. 90° that it engages over the yarn guide ring 14 from the outside and projects into the space between two brackets 15. The yarns 12 are preferably so guided that the outer end of each tube 28 including the blower opening 47 can oscillate to and fro in the space which is bounded by the yarn 12 and the yarn guides 13 and is bounded in the circumferential direction by two brackets 15, as appears in particular from FIG. 2. It will be understood that in an angular sector of e.g. about 90° bounded by two brackets 15 there will be a plurality of e.g. up to twenty-four yarns 12 leading to twenty-four knitting systems distributed round the periphery of the needle cylinder 3, of which only one is shown in FIG. 2. The device according to the invention thus facilitates, as FIG. 2 clearly shows, leading the blower openings 47 radially from the outside up close to those places where the yarns 12 are laid into the knitting needles 4 and where as a rule a lot of fluff occurs.

Alternatively, it is naturally possible to arrange the tubes 29 and the blower openings 47 differently. In FIG. 2 two possible positions 28*a*, 47*a* and 28*b*, 47*b* respectively are shown in full and broken lines respectively, where the blower openings 47*a*, 47*b* are at different levels and are each arranged at the backs of the knitting needles 4, in order to blow on to these from positions lying radially inside.

The blower openings 48, 49 on the tube 29 (FIGS. 2 and 4) differ from the blower openings 47 in that they are disposed on the tubes 29 in pairs in the manner of a double nozzle and point in opposite directions as seen in the circumferential direction of the needle cylinder 3. It is possible in this way to reach such regions as lie directly under the brackets 15. Corresponding pairs of blower openings 50, 51 can also be provided on the tubes 28*c* (FIG. 4) in order to blow on to the needle ring in pairs from the outside.

As is schematically shown in FIGS. 1, 3 and 4, the flexible hoses 33 (FIG. 2), which are shown essentially in FIG. 4 by the broken lines 35 also used in FIG. 1, are each connected to an output of the distribution device 34, which e.g. has a connecting line 52 for each hose 33 connected to a source 56 of compressed air through a controllable valve 53, a compressed air indicator 54, e.g. a conventional manometer and a pressure regulator 55, e.g. a throttle, the source being for example a compressed air outlet at a few bar customarily present in knitting sheds. The distribution device 34 further comprises a switch panel 58 connected through control lines 57, which is supplied with current by a line 59 and has e.g. a switch 60 with which the selected state can be set (e.g. automatic or manual control of the distribution device 34). The control program for the distribution device 34 can be entered by keys 61 of the switch panel 58, in order to establish how frequently the rotary drive 37 (FIG. 2) is switched on and at what pressure or how frequently and with what turn on time the compressed air is to be fed to the various tubes 28, 29. The latter is effected for example in that the controllable valves 53 are connected to a sequence controller containing a time-switch or the like and which determines the turn-on and turn-off times and in that the pressure regulators 55 are individually adjusted to a preselected pressure. The distribution device 34 is preferably so designed that the tubes 28, 29 are connected to the compressed air source 56 individually one after the other or possibly in a predetermined time sequence, so that only one tube 28, 29 is connected to the compressed air source 56 at any one time and the maximum air pressure is applied to each tube 28, 29, although it would also be possible to connected e.g. two of the tubes 28, 29 to the compressed air source 56 at the same time, if the capacity the latter is sufficiently large. The switch panel 58 can also have other switches which e.g. facilitate stopping automatic control or making other manual adjustments.

The described design and arrangement of the tubes 28, 29 and blower openings 47 to 51 makes it possible to direct the latter to practically any desired location in the circular knitting machine, where the oscillating movement limited to a predetermined angular range ensures at the same time that blowing on to the knitting needles 4 from the front, i.e. radially from the outside is possible, in spite of the presence of the yarn guide ring 14, and the supports 15, without impeding the yarn feed. Moreover the flexible hoses 33 on the one hand directly, given adequate length, allow the limited oscillating movement while on the other hand they facilitate in a simple manner individual application of compressed air to the tubes 28,29, so that a compressed air source 56 with a comparatively small capacity can be provided.

The described blowing device is preferably automatically switched on before starting the circular knifing machine and automatically switched off with a small delay when the circular knitting machine is stopped. An additional control valve can be fitted between the distribution device 34 and the compressed air source 56 for example and be automatically turned on and off when starting and stopping the circular knitting machine respectively.

Figure 5:
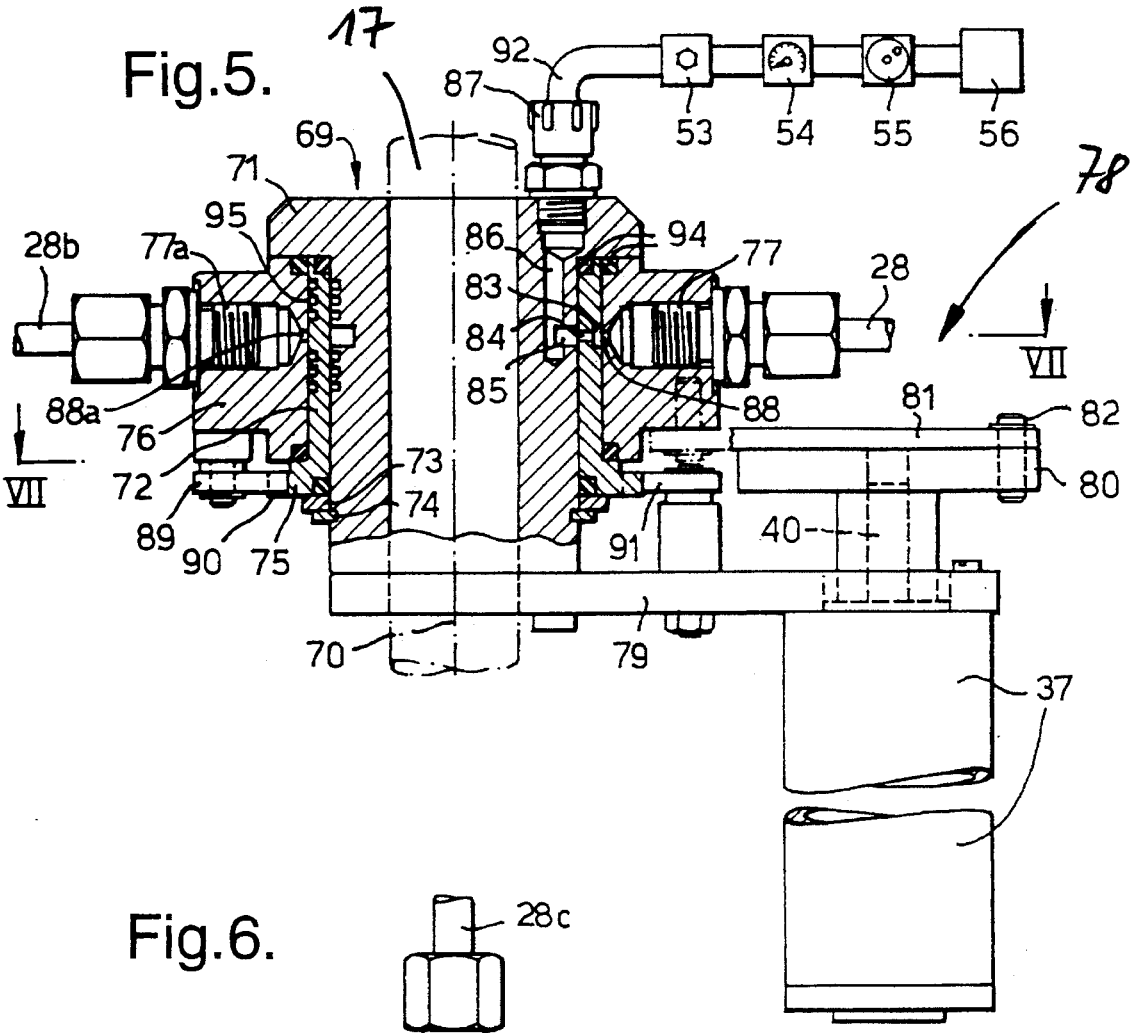
FIG. 5 is a vertical section through a second embodiment of the device according to the invention.
Figure 6:
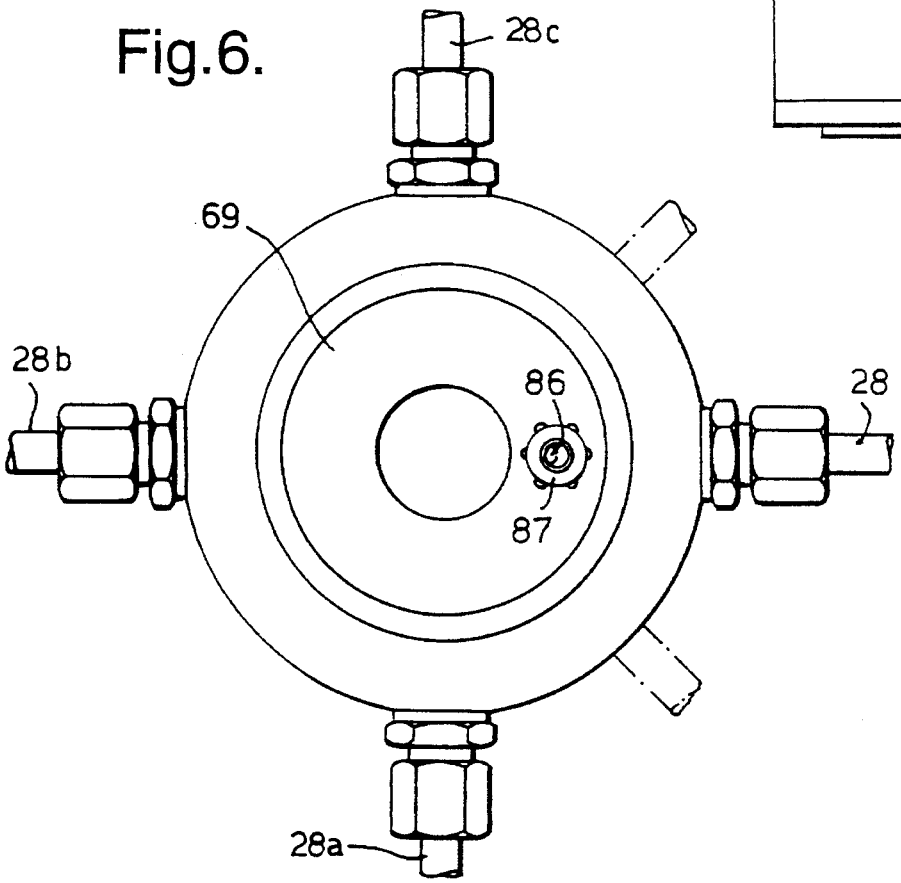
FIG. 6 is a schematic plan view of the device according to FIG. 5.
Figure 7:
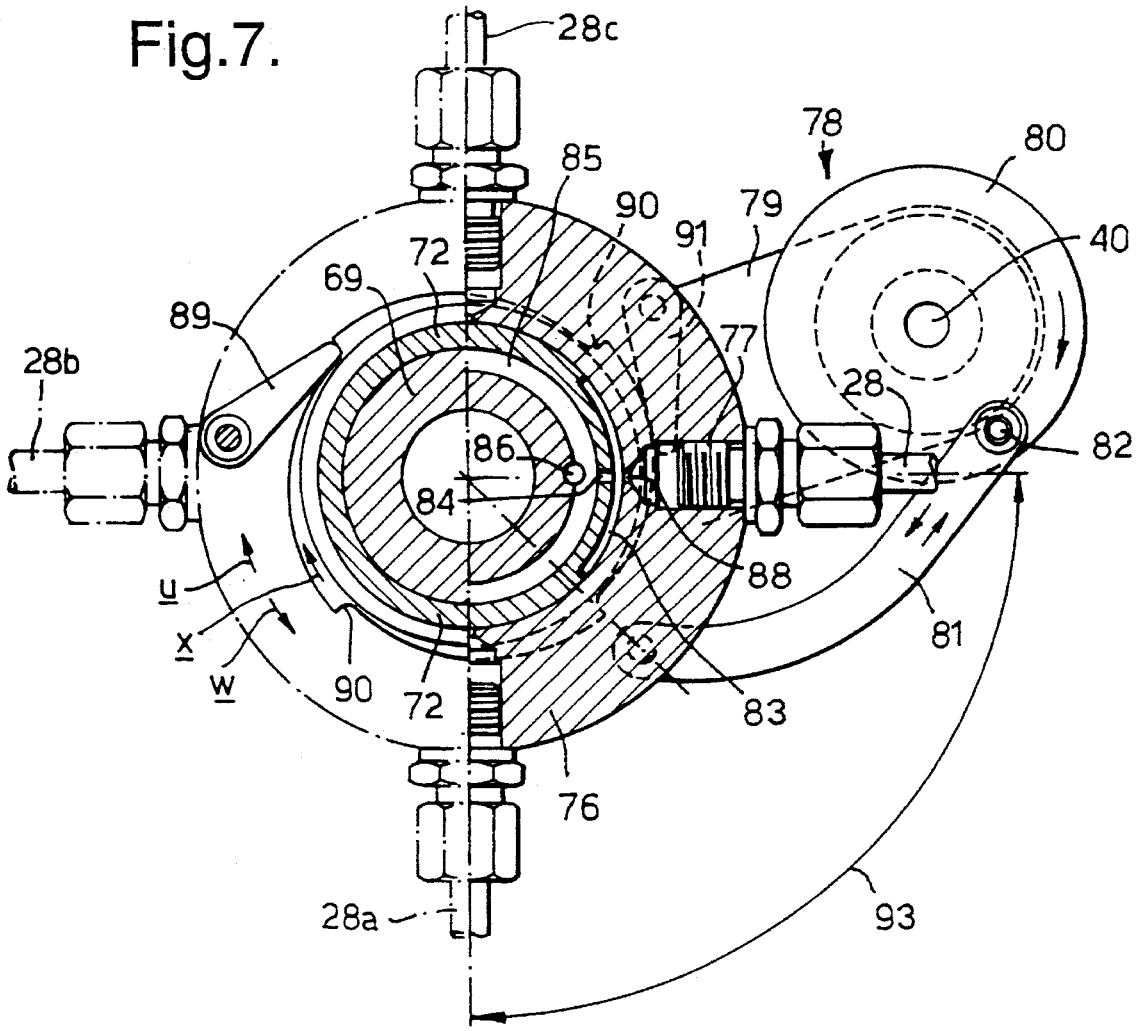
FIG. 7 is a section along the line VII—VII of FIG. 5.

In the embodiment according to FIGS. 5 to 7, which is up to now held to be the best one, there is a hollow cylindrical housing 69 like in FIG. 1, having an axis 70 and an upper, flange-like projection 71, fixed on the rod 17. A distribution device comprises in particular a distribution bush 72 with a suitable inner cross-section, which is mounted rotatably and coaxially on the housing 69, between the projection 71 and a support ring 73 fitted on to the housing 69 from below and is thus secured against axial movement on the housing 69. The support ting 73 is for its part secured against axial displacement by means of a circlip 74 engaging thereunder and fixed to the housing 69.

The distribution bush 72 has a lower, flange-like projection 75, on which a coaxially fitted holder 76 is supported rotatably and moreover fixed axially relative to the distribution bush 72 between this projection 75 and the projection 71 of the housing 69. The holder 76 has a plurality of hollow chambers 77 as in the embodiment of FIGS. 1 to 4 and one of the tubes 28, 29 is connected to each hollow chamber 77 in that it is screwed into a passage leading into the corresponding hollow chamber 77, or is fixed by a back-nut to the holder 76.

The holder 76 carrying the robes 28, 29 can, like the holder 23 according to FIGS. 1 to 4, be oscillated to and fro about the axis 70 by a crank drive 78. The crank drive 78 includes the rotary drive 37, which is fixed on a support plate 79 fitted to the underside of the housing 69, and a crank disc 80 fixed coaxially on its drive shaft 40, which disc has an eccentrically mounted pin 82 pivoted to one end of a connecting rod 81. The other end of the connecting rod 81 is pivoted at an eccentrically disposed pivot point on the underside of the holder 76, so that rotation of the crank disc 80 about an axis parallel to the axis 70 results in an oscillating to and fro movement of the holder 76 about the axis 70. The arrangement and design of the tubes 28, 29 are analogous to the embodiment of FIGS. 1 to 4.

The control of the air feed to the tubes 28, 29 is effected in the embodiment according to FIGS. 5 to 7 with the aid of the distribution bush 72. This has at least one distribution channel 83, which in the embodiment consists of a groove formed in the outer surface of the distribution bush 72 and extending in the circumferential direction over a region of less than 360°, here 90° for example, and in communication through an opening passing through the distribution bush 72 with an annular channel 85, which is formed in the inner surface of the distribution bush 72 and/or in the outer surface of the housing 69 and runs round the axis 70. This annular channel 85 is on the one hand in permanent communication with a connecting union 87 through a channel 86 parallel to the axis and preferably formed in the positionally fixed housing 69. On the other hand, the annular channel 85 can be connected selectively with any of the hollow chambers 77. To this end the holder 76 has wherever there is a hollow chamber 77 a passage 88, through which each hollow chamber 77 can be connected to the distribution channel 83, which is in permanent communication with the annular channel 85, depending on the rotational position of the holder 75 and the distribution bush 72.

The holder 76 is provided on its underside with a drive pawl 89, which can pivot about an axis parallel to the axis 70 and cooperates with a plurality of teeth 90 which are provided at a suitable axial height on the outer periphery of the distribution bush 72. The arrangement is such that, in each forward stroke of the holder 76 effected by the crank drive 78 in the direction of an arrow u (FIG. 7) , the distribution bush 72 is turned through a corresponding angle of rotation in the direction of an arrow x, whereas the distribution bush 72 stays stationary when the holder 76 executes its backwards movement in the direction of an arrow w. Inadvertent reverse rotation of the distribution bush 72 can be prevented with the aid of a blocking pawl 91 shown only schematically, which cooperates with corresponding toothing on the distribution bush 72.

The connecting union 87 is connected by a connecting line 92, e.g. a flexible hose or the like, to the compressed air source 56, where as in FIG. 4 a controllable valve 53, a pressure indicator 54 and a pressure regulator 55 can be additionally provided. The other parts shown in FIG. 4, including the switch panel 58 can however be omitted.

The device described with reference to FIGS. 5 to 7 operates as follows:

With the rotary drive 37 switched on the crank disc 80 rotates in the direction of the indicated arrow, while the connecting rod 81 and the holder 76 therewith are moved to and fro in the direction of the arrows u and w, whereby the oscillating movement of the holder 76 is indicated in FIG. 7 by an arrow 93 and amounts to about 90° in the embodiment. The dimensions of the various pans are so selected that the passage 88 of the hollow chamber 77 for example is in constant communication with the distribution channel 83 and thereby with the annular channel 85 during this movement of the holder 76, even when the distribution channel 83 is turned through a step in the direction of the arrow u together with the holder 76 in the forward stroke. With the valve 53 open, compressed air therefore flows during the whole of the oscillating motion in the tube 28 connected to the hollow chamber 77. At the same time the other hollow chambers 77, e.g. a hollow chamber **77*a* shown on the left in FIG. 5, are not connected to the compressed air source 56, because their rear passage 88*a* is not connected to any distribution channel 83 and to no wall section of the distribution bush 72 having an opening 84**.

In the next stroke of the crank drive 78, the distribution bush 72 together with the holder is turned through a further step of e.g. 90° in the direction of the arrow u. Accordingly, the distribution channel 83 comes into the region of a passage 88 which pertains to a tube **28*a* (FIG. 6) which follows in the direction of rotation, so that compressed air is now fed to this tube 28*a*. Further tubes 28*b* and 28*c* are fed one after the other in corresponding manner in the following steps, until in the fifth step the tube 28 is again connected to the compressed air source 56**.

One selected tube is always connected in the manner described to the compressed air source 56, while the passage of the compressed air to the other tubes 28 or 29 is blocked. Accordingly the pans 35, 52, 53, 54 and 55 need only be provided singly, in contrast to FIG. 4.

In the embodiment the distribution bush 72 is rotatably arranged between the fixed housing 69 and the oscillating holder 76. The length of the distribution channel 83 regarded in the direction of the arrow u can be chosen quite differently, depending on the number of tubes 28 or 29 as well as in dependence on the size of the crank stroke in a particular case and correspond for example with the provision of six tubes at a spacing of 60° to an angle of rotation of 60° or with provision of three tubes 28 spaced at 120° to an angle of rotation of 120°. The spacing of the teeth 90 round the periphery of the distribution bush 72 has to be selected correspondingly.

If it is desired that the cleaning operation shall always take place through a plurality of tubes 28 or 29, the distribution channel 83 in FIG. 7 could be of e.g. double length. Alternatively it would also be possible to provide a further distribution channel at a location on the distribution bush 72 diametrically opposite the distribution channel 83, so that two diametrically opposite tubes 28, 29 are always connected at the same time to the compressed air source 56. In corresponding manner, the length of the distribution channel 83 can also be made shorter, so that the tubes 28, 29 are only connected to the compressed air source 56 during a part of the forward or return stroke of the holder 76. Thus the blowing duration 83 for the individual tubes 28 can also be adjusted by the length of the distribution channel.

It will further be understood that suitable sealing means are provided to prevent the escape of compressed air in the region of the butt joints between the housing 69, the distribution bush 72 and the hollow chambers 77. Thus, sealing rings 94 are shown in the right part in FIG. 5 and labyrinth seals 95 in the left part.

The invention is not limited to the described embodiments, which can be modified in many ways. This applies in particular to the design and arrangement of the tubes 28, 29 or the blower openings 47 to 51, which can be varied within wide limits, even if a double arrangement (48, 49 or 50, 51) has so far been seen as the best solution. A particularly preferred embodiment consists moreover e.g. in that the blower openings are formed on blower nozzles which are connected to the tubes 28, 29 pivotally and adjustably and therefore can each be so adjusted as is desired in the particular case. Alternatively it would be possible also to this end to provide the device with a plurality of sets of differently shaped tubes and/or differently shaped blower nozzles, in order that these may be interchanged as required, e.g. as is indicated by the different tubes 28 to 28*c* and 29.

Furthermore, it is possible to provide instead of the four brackets 15 more or less such brackets and to form the crank drives 36 and 78 correspondingly so that each tube 28, 29 is moved over an angular range of less than or more than about 90° in the oscillating movement. It would also be possible to make the hub 21 and the holder 23 in one piece, in which case the pin 25 would be obviated, and/or to make the disc 22 merely as a lever or arm, which leads to the pivot point 44. Oscillating drives other that the crank drive shown could be provided.

Apart from this, the design and the control of the distribution device 34 of the embodiment first described are entirely at the will of the man skilled in the art and can be so selected to suit the practical requirements in a particular case. Overall the invention offers the advantage that the particular parameters can be freely selected other than is the case in known blowing devices. It is moreover an advantage that the device according to the invention can also be Subsequently fitted to circular knitting machines which have already been installed or be offered as an accessory for circular knitting machines, since it is merely necessary for this to mount the rod 17 in the centre of the circular knitting machine, should it not already be present for other reasons (e.g. as a lamp holder). The distribution device 34 can for example be fitted in an already existing or additionally fitted switch cabinet provided beside the machine or in the frame 1. Moreover it will be understood that the device according to the invention can also be used with circular knitting machines which have a stationary needle cylinder and a rotatable cam box ring.

With reference to the embodiment according to FIGS. 5 to 7, it is possible to arrange the distribution bush 72 or a corresponding distribution device above or below the housing 69 and the holder 76, instead of between these and to advance it in a different way than with the crank drive 78. In particular it is possible to form the various channels and openings other than as shown, since this is largely unimportant to the desired function. This applies for example in that the distribution channel 83 of the distribution device could also be formed in the holder 76 and be combined with a simple aperture in the distribution bush 72. The described individual parts could in addition naturally be used in other than the combinations shown.

Finally the device according to the invention is not restricted to fixing thereof to the rod 17 arranged in the middle of the needle cylinder. In principle the rod 17 could also be replaced by a different structure, which further does not have to be arranged exactly coaxial with the axis 2 of the needle cylinder, insofar as such deviations from the central position can be compensated for the suitably formed tubes 28, 29. Such constructions could be desirable above all if applied to circular knitting machines which also have a dial or the like outside the needle cylinder, in which case the rod 17 can be replaced by a dial carrier.

While the invention has been illustrated and described as embodied in a circular knitting machine, it is not intended to be limited to the details shown, since various modifications and structural changes may be made without departing in any way from the spirit of the present invention, particularly with respect to other textile machines.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for a circular knitting machine for blowing away fluff, comprising: a central rod-like mounting means (17) defining an axis (2, 70); a holder (23, 76) rotatably mounted on said mounting means for rotating around said axis; a plurality of hollow chambers (27, 77) provided in said holder; a distribution device (34, 72) being connectable with a source (56) of compressed air; means connecting said chambers with said distribution device; a plurality of blower opening (47–51), said openings being substantially radially and outwardly spaced from said holder and being distributed around said axis; a plurality of tubes (28, 72) each connecting a blowing opening with an associated one of said chambers; and means for rotating to and fro said holder, said distribution device having means (53, 83) for providing said blowing openings via said chambers with compressed air from said source in a way selected from the group consisting of providing in a predetermined sequence and providing in groups.

2. A device according to claim 1, and further comprising a rotary drive, said means for rotating to and fro said holder including a crank drive (36) connected between said holder and said rotary drive (37).

3. A device according to claim 1, wherein said mounting means include a rod (17) having said axis (2, 70), said holder being mounted on said rod.

4. A device according to claim 3, wherein the rod (17) is hollow and the tubes (28,29) are connected to the distribution device (34) with the aid of flexible hoses (33) arranged at least partially in the rod (17).

5. A device according to claim 1 further comprising a plurality of sets of tubes having different blowing openings.

6. A device according to claim 1, wherein said blower openings are formed in blower nozzles being arranged on said tubes in a manner to be individually tiltable and adjustable.

7. A device according to claim 1, and further comprising a housing mounted on said mounting means; and means connectable to said source of compressed air, said distribution deice including a distribution bush (72) movable stepwise, said bush being mounting means and said holder housing (69) mounted on said mounting means and said holder (76) and being provided with at least one connecting mans (83) which connects in dependence on its rotary position at least a selected one of said chambers with said means (87) which is connectable to said source of compressed air (56).

8. A device according to claim 7, wherein said connecting means (83) has a distribution channel of predetermined length extending in the direction of rotation.

9. A device according to claim 7, wherein said distribution bush (72) is provided with teeth (90) and said holder (76) is provided with a drive pawl (89) which cooperates with said teeth (90) for stepwise rotating said distribution bush.

10. A device according to claim 7; and further comprising scaling means (94, 95) for preventing an escape of compressed air in a region of butt joints between said housing (69), said bush (72) and said chambers (77).

11. A circular knitting machine comprising: a needle cylinder (3) having an axis (2) and knitting instrumentalities (4); a cam box ring (5) having cams (6) for controlling said knitting instrumentalities for knitting purposes; and a device blowing away fluff arising during knitting, said device including a rod-like mounting means mounted coaxial with said axis, a holder (23, 76) rotatably mounted on said mounting means for rotating around said axis, a plurality of hollow chambers (27, 77) provided in said holder, a distribution device (34, 72) connectable with a source (56) of compressed air, means connecting said chambers with said distribution device, a plurality of blower openings (47–51), substantially radially and outwardly spaced from said holder and distributed around said axis, a plurality of tubes (28, 72) each connecting a blowing opening with an associated one of said chambers, and means for rotating to and fro said holder, said distribution device having means (53, 83) for providing said blowing openings via said chambers with compressed air from said source in a way selected from the group consisting of providing in a predetermined sequence and providing in groups.

12. A circular knitting machine according to claim 14, further comprising a yarn guide ring (14) supported in fixed position on brackets (15) about the needle cylinder (3), wherein a stroke of the to and fro movement of the holder corresponds to the spacing of the brackets (15).

13. A circular knitting machine according to claim 12, further comprising a plurality of knitting systems being arranged along the periphery of the needle cylinder (3), to each of which at least one yarn (12) is fed from a location disposed radially outside the yarn guide ring (14), wherein the blower openings (47) are arranged in an annular space which is formed by the yarn guide ring (14) and the yarns (12).

14. A circular knitting machine according to claim 12, wherein a double nozzle is associated with at least one tube (29) and has two blower openings (48,49) oppositely directed in the circumferential direction of the needle cylinder (3).

15. A circular knitting machine according to claim 11, wherein said mounting means includes a rod which is suspended from radial arms connected to a support ring (10).

16. A device for a circular knitting machine for blowing away fluff, comprising a holder (23, 76) mounted to rotate to and fro; a plurality of blower openings (47–51); a plurality of tubes (28, 29) coupled to said holder and connected with said blower openings, said tubes (28, 29) extending substantially radially from said holder; and a distribution device (34, 72) connected with said tubes (28, 29) and connectible to a source of compressed air (56), said distribution device (34, 72) having means (53, 83) for providing the tubes (28, 29) with compressed air in a predetermined sequence individually or in groups, said distribution device having means (55) for adjusting the air pressure individually in each tube.

17. A device for a circular knitting machine for blowing away fluff, comprising a holder (23, 76) mounted to rotate to and fro; a plurality of blower openings (47–51); a plurality of tubes (28, 29) coupled to said holder and connected with said blower openings, said tubes (28, 29) extending substantially radially from said holder; and a distribution device (34, 72) connected with said tubes (28, 29) and connectible to a source of compressed air (56), said distribution device (34, 72) having means (53, 83) for providing the tubes (28, 29) with compressed air in a predetermined sequence individually or in groups, said distribution device having means (53, 83) for adjusting the duration of the compressed air feed to the individual tubes (28, 29).

18. A device for a circular knitting machine for blowing away fluff, comprising a holder (23, 76) mounted to rotate to and fro; a plurality of blower openings (47–51); a plurality of tubes (28, 29) coupled to said holder and connected with said blower openings, said tubes (28, 29) extending substantially radially from said holder; and a distribution device (34, 72) connected with said tubes (28, 29) and connectible to a source of compressed air (56), said distribution device (34, 72) having means (53, 83) for providing the tubes (28, 29) with compressed air in a predetermined sequence individually or in groups, said at least one means of said bush having a distribution channel (83) of predetermined length extending in direction of rotation.

19. A device for a circular knitting machine for blowing away fluff, comprising a holder (23, 76) mounted to rotate to and fro; a plurality of blower openings (47–51); a plurality of tubes (28, 29) coupled to said holder and connected with said blower openings, said tubes (28, 29) extending substantially radially from said holder; and a distribution device (34, 72) connected with said tubes (28, 29) and connectible to a source of compressed air (56), said distribution device (34, 72) having means (53, 83) for providing the tubes (28, 29) with compressed air in a predetermined sequence individually or in groups, said holder (76) being provided with a drive pawl (89) which cooperates with teeth (90), the distribution bush (72) being provided with teeth (90) cooperating with said drive pawl (89) for stepwise rotating said distribution bush.

* * * * *